United States Patent [19]

Yourtee et al.

[11] Patent Number: 4,828,681

[45] Date of Patent: May 9, 1989

[54] PROCESS OF THERMALLY CRACKING HYDROCARBONS USING PARTICULATE SOLIDS AS HEAT CARRIER

[75] Inventors: John B. Yourtee, Flanders; John M. Matsen, Annadale, both of N.J.

[73] Assignee: Exxon Research & Engineering Company, Florham Park, N.J.

[21] Appl. No.: 5,332

[22] Filed: Jan. 15, 1987

Related U.S. Application Data

[63] Continuation of Ser. No. 686,131, Dec. 24, 1984, abandoned.

[51] Int. Cl.[4] ..... C10G 9/32

[52] U.S. Cl. ..... 208/127; 208/126; 208/161

[58] Field of Search ..... 208/126, 127, 130, 161, 208/164; 422/147, 232; 34/79

[56] References Cited

U.S. PATENT DOCUMENTS

| | | | |
|---|---|---|---|
| 2,432,962 | 12/1947 | Bergstrom | 196/55 |
| 2,436,160 | 2/1948 | Blanding | 196/55 |
| 2,714,126 | 7/1955 | Keith | 260/679 |
| 2,737,479 | 3/1956 | Nicholson | 196/55 |
| 2,878,891 | 3/1959 | Ross et al. | 183/34 |
| 3,074,878 | 1/1963 | Pappas | 208/127 |
| 3,113,985 | 12/1963 | Metrailer | 208/127 |
| 3,365,387 | 1/1968 | Cahn et al. | 208/48 |
| 3,764,634 | 10/1973 | Osawa et al. | 260/683 |
| 4,057,490 | 11/1977 | Wyne, Jr. | 266/127 |
| 4,061,562 | 12/1977 | McKinney et al. | 208/127 |
| 4,061,562 | 12/1977 | McKinney et al. | 208/61 |
| 4,080,285 | 3/1978 | McKinney et al. | 208/127 |
| 4,097,362 | 6/1978 | McKinney et al. | 206/78 |
| 4,097,363 | 6/1978 | McKinney et al. | 206/78 |
| 4,172,857 | 10/1979 | Pavillon | 965/638 |
| 4,263,128 | 4/1981 | Bartholic | 208/127 X |
| 4,264,432 | 4/1981 | Gartside | 208/48 |
| 4,268,375 | 5/1981 | Johnson | 208/72 |
| 4,300,998 | 11/1981 | Gartside | 208/127 |
| 4,309,272 | 1/1982 | Johnson et al. | 208/72 |
| 4,318,800 | 3/1982 | Woebke et al. | 208/127 |
| 4,338,187 | 7/1982 | Gartside et al. | 208/127 |
| 4,348,364 | 9/1982 | Gartside et al. | 422/214 |
| 4,351,275 | 9/1982 | Bhojwani et al. | 122/7 |
| 4,352,728 | 10/1982 | Gartside et al. | 208/127 |
| 4,356,151 | 10/1982 | Woebcke et al. | 422/145 |
| 4,370,303 | 1/1983 | Woebcke et al. | 422/144 |
| 4,379,046 | 4/1983 | Oldweiler | 208/54 |
| 4,411,769 | 10/1983 | Oldweiler | 208/54 |
| 4,427,538 | 1/1984 | Bartholic | 208/127 |

FOREIGN PATENT DOCUMENTS 26674 1/1980 European Pat. Off. .

OTHER PUBLICATIONS

"Ethylene" in *Chemical Week*, Nov. 13, 1965, pp. 69–81.

J. P. Holman, "Heat Transfer", McGraw Hill, 1963, pp. 9–11, 88–91 and 107–111.

Eckert and Drake, "Heat and Mass Transfer", McGraw Hill, 1959, pp. 124–131, and 167–173.

C. E. Lapple and C. B. Shepherd, *Industrial and Engineering Chemistry*, vol. 32, pp. 605–617, May 1940.

*Primary Examiner*—Glenn Caldarola

*Attorney, Agent, or Firm*—S. H. Markowitz; R. Yablonsky; T. B. Morris

[57] ABSTRACT

The invention relates to carrying out thermal cracking of hydrocarbons, or other thermal conversions of organic substances in a reactor, for which a suitable reaction time is extremely short, e.g. of the order of milliseconds. Particulate solids are used as heat carrier and as feed an organic substance is used in the form of a gas which may contain some liquid; the hot particulate solids are introduced at low or no velocity into contact with the gas, which is at substantially higher velocity; the solids accelerate in passing through the reactor but the reaction is terminated substantially before the solids attain the velocity of the product gas. Contact times are short so that the solids do not accelerate to erosive speeds. The velocity differential enhances the heat transfer rate which makes short reaction times feasible.

26 Claims, 4 Drawing Sheets

PROCESS OF THERMALLY CRACKING HYDROCARBONS USING PARTICULATE SOLIDS AS HEAT CARRIER

This is a continuation of application Ser. No. 686,131 filed 12/24/84 now abandoned.

FIELD OF THE INVENTION

This invention relates to an improvement in carrying out reactions of a thermally reacting fluid in which a suitable reaction time is extremely short, e.g. of the order of milliseconds. Thus this invention relates to a process of thermally cracking hydrocarbons using particulate solids as heat carrier and more particularly to a process in which solids are injected at low velocity into a hydrocarbon feed gas stream and accelerate but are separated before they accelerate to full fluid velocity. Suitable apparatus therefor is described, in particular a more effective reactor/separator.

BACKGROUND OF THE INVENTION

The thermal cracking of hydrocarbons including gaseous paraffins up to naphtha and gas oils to produce lighter products, in particular ethylene, has developed commercially as the pyrolysis of hydrocarbons in the presence of steam in tubular metal coils disposed within furnaces. Studies indicate that substantial yield improvements result as temperature is increased and reaction time is decreased. Reaction time is measured in milliseconds (ms).

Conventional steam cracking is a single phase process in which a hydrocarbon/steam mixture passes through tubes in a furnace. Steam acts as a diluent and the hydrocarbon cracks to produce olefins, diolefins, and other by-products. In conventional steam cracking reactors, feed conversion is about 65%. Conversion is limited by the inability to provide additional sensible heat and the heat of cracking in a sufficiently short residence time without exceeding TMT (tube metal temperature) limitations. Long residence time at high temperature is normally undesirable due to secondary reactions which degrade product quality. Another problem which arises is coking of the pyrolysis tubes.

Such steam cracking process, referred to as "conventional" hereinafter, is described or commented on in U.S. Pat. Nos, 3,365,387 and 4,061,562 and in an article entitled "Ethylene" in Chemical Week, Nov. 13, 1965, pp. 69–81, which are incorporated by reference.

In contradistinction to coil reactors in which heat transfer is across the wall of the coil and which thus are TMT-limited crackers, methods have also been developed that use hot recirculating particulate solids for directly contacting the hydrocarbon feed gas and transferring heat thereto to crack the same.

Methods in this category, designated TRC process, are described in a group of Gulf/Stone and Webster patents listed below which, however, are limited to longer residence times (50–2000 ms) and conventional temperatures, as compared with the present invention.

| U.S. Pat. Nos.: | |
|---|---|
| 4,057 490 | 4,309,272 |
| 4,061,562 | 4,318,800 |
| 4,080,285 | 4,338,187 |
| 4,097,362 | 4,348,364 |
| 4,097,363 | 4,351,275 |
| 4,264,432 | 4,352,728 |

-continued

| U.S. Pat. Nos.: | |
|---|---|
| 4,268,375 | 4,356,151 |
| 4,300,998 | 4,370,303 |
| European Application 80303459.4. | |

It should be noted that U.S. Pat. No. 4,061,562 in column 2, states that there is little or no slippage between the inert solids and the flowing gases (slip is the difference in velocity between the two). A similar connotation is found in U.S. Pat. No. 4,370,303, column 9, which cautions against gas at above 125 to 250 ft./sec. because then erosion is accelerated. Lowering gas velocity makes other steps slower also, for example, separation of solids from gas, thus adds to overall residence time. Further, one may reach a point in restricting gas velocity where good mixing of solids and gas is not achieved because high gas velocity causes turbulence and intimate mixing which are desirablfe. In a sense this invention uncouples the gas velocity from the solids velocity, that is, the former does not have to be geared to the latter in order to avoid erosive solids speed but rather the gas velocity can be relatively high and still avoid that result.

Other patents of general interest include:

| U.S. Pat. Nos.: | |
|---|---|
| 2,432,962 | 2,878,891 |
| 2,436,160 | 3,074,878 |
| 2,714,126 | 3,764,634 |
| 2,737,479 | 4,172,857 |
| 4,379,046 | 4,411,769 |

SUMMARY OF THE INVENTION

This invention concerns the accelerating solids approach to fluid-solids contact and heat transfer. In this invention, relatively low velocity particulate solids are contacted with a relatively high velocity fluid, and then separated before particulate velocity can approach the fluid velocity, thereby minimizing erosion/attrition.

If there is a temperature difference between these species, during momentum transference, the velocity difference between the solids and fluid when coupled with the high particulate surface area results in enhanced heat transfer. By virtue of this phenomenon one can optimize the process, i.e. by maximizing the differential velocity one can obtain extremely rapid heat transfer. Hence there should be a significant differential velocity in the direction of gas flow. This heat transfer can be controlled by appropriate choice of relative initial velocities, particle characteristics (size, geometry, thermal), and weight ratio of solid to fluid. Particles are separated preferably with an inertial separator, which takes advantage of their significantly greater tendency than the fluid to maintain flow direction.

For a reactive fluid in contact with particles of sufficient temperature to initiate significant reaction, such a system permits very short residence times to be practically obtained. Quench of the product fluid stream can then be effected without also quenching the particulate solids, which can thus be recycled with minimum thermal debit.

That is to say, a unique aspect of the invention is the application of the accelerating solids approach to solids/feed heat transfer. Low velocity, e.g. 1–50 ft./sec., hot particles contact higher velocity, relatively cool gas, e.g. 50–300 ft./sec., and are then separated using an inertial separator before detrimental particle velocity is reached. The large gas/solids velocity difference that results, when coupled with the high particle surface area and thermal driving force, provides extremely rapid heat transfer. Thus in the conversion of gaseous hydrocarbons using particulate solids as heat carrier, most ofthe heat transfer, particle to gas, occurs before the particle approaches the maximum fluid velocity. Since the particle erosion may vary as much as the cube of the speed, erosive wear to the process equipment can be reduced considerably if the particles are removed from the gas before attaining substantially full fluid velocity.

Thus the accelerating solids concept is used to provide rapid heat transfer while minimizing erosion. Other benefits also accrue. Solids enter the reactor at relatively low velocity, whereas feed enters at substantially higher velocity. The solids gain momentum from the gas and accelerate through the reactor but never approach the full gas velocity. This allows several things to occur: gas residence times in the reactor are kept low, e.g. 10–20 ms because contact time between solids and gas is cut short; heat transfer is very rapid, e.g. heatup rate $\sim 10^6$° F./sec. because slip velocities are kept high (thermal boundary layer is thin); erosion/attrition is minimized as the solids velocity is kept low, preferably below 150 ft./sec. That is, when the velocity difference is increased, the thermal boundary layer is thinned out and heat transfer is improved. Pressure drop, which is deleterious to the thermal cracking of hydrocarbons to produce yields of ethylene, diolefins and acetylenic molecules, is minimized by minimizing the acceleration of the particles by the kinetic energy of the fluid. Thus the improvement of this invention has a dual aspect: contact times are short so that the solids do not accelerate to erosive speeds; the velocity difference causes a higher heat transfer rate so that short reaction times are feasible.

Theoretical discussions may be found in:

J. P. Holman, "Heat Transfer", McGraw-Hill, 1963, pp. 9–11, 88–91 and 107–111; and Eckert and Drake, "Heat and Mass Transfer", McGraw Hill, 1959, pp. 124–131 and 167–173.

However, the application of the principles there set forth to carrying out reactions of thermally reacting fluids which require extremely short residence time, is not disclosed or suggested. The reactions may be catalytic or non-catalytic.

Accordingly the invention comprises a process for thermally cracking hydrocarbons wherein hydrocarbon feed gas is contacted with hot particulate solids in a reactor by: introducing the solids at negative velocity or at low or no velocity into contact with feed gas at substantially higher velocity, to entrain the solids in the gas, transfer heat from solids to gas and crack the same, allowing the solids to accelerate in passing through the reactor and terminating the reaction substantially before the solids attain the velocity of the gas, e.g. separating solids from product gas while the solids are substantially below the velocity of the gas and then quenching the product gas. Negative velocity means that the particles are thrown into the reactor in a direction away from the direction of gas flow and are then carried by the gas in the direction of gas flow. Preferably the particles are simply dropped into the reactor to fall by gravity into contact with the gas. The process may be carried out by introducing 50–300 $\mu$, preferably 100–200 $\mu$ particles at negative velocity or at 0–50 ft./sec. heated to a temperature in the range of about 1700° to 3000° F. into contact with feed gas at substantially higher velocity in the range of from about 30 ft./sec., preferably 50 ft./sec. up to 500 ft./sec., e.g. 100–500 ft./sec., preferably 300–400 ft./sec., preheated to a temperature in the range of about 500° to 1275° F., preferably 700° to 1110° F., to crack the same at reaction temperatures in the range of about 1500°–2200° F., preferably 1500° to 2000° F., for a reactor gas residence time of 10–40 ms. The solids/feed ratio may suitably be in the range of 5–200 lb/lb feed.

The components in the resulting mixture of feed hydrocarbon and entrained solids, with or without gaseous diluent, flow concurrently through the reactor at the aforesaid temperatures. Multiplication of the number of moles of hydrocarbon through cracking and rise in temperature of the vapor by heat transfer increase vapor velocity whereas the drag on the gas by the solids (as their velocity increases) tends to lower gas velocity.

In general, according to this invention, the solids will be accelerated to not more than 80%, preferably not more than 50%, of the velocity of the gas with which they are in contact. The minimum solids final velocity is not critical but will generally be at least 20% of the final gas velocity.

The overall residence time which includes time for the contacting, reaction and separation, is generally above 10 to less than 100 ms, preferably above 10 up to 50 ms, e.g. 20 to 50 ms.

BRIEF DESCRIPTION OF THE DRAWINGS

The invention is further elucidated in the drawings which are illustrative but not limitative. In the drawings.

DETAILED DESCRIPTION OF THE INVENTION

Figure 1:
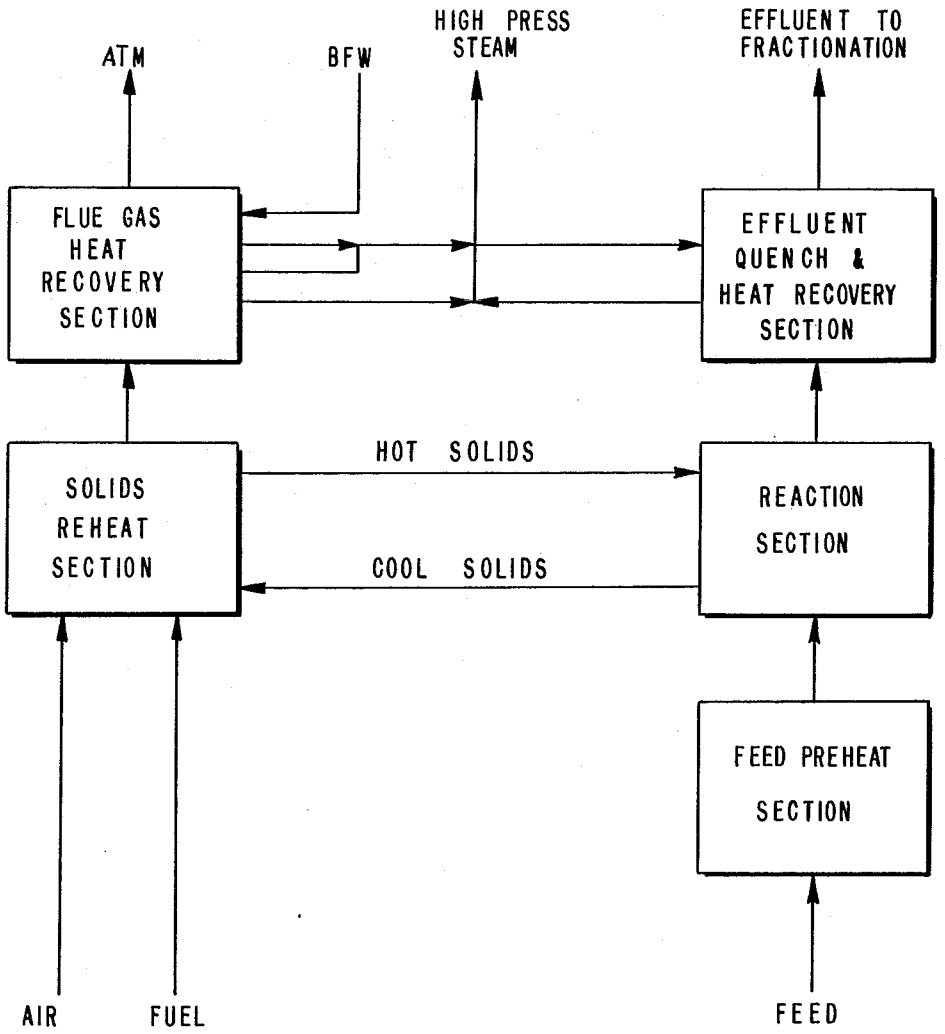
FIG. 1 is a block flow diagram showing one embodiment of the general layout of the process of this invention.

Although the process may be used for any feeds usable in conventional steam cracking, it is most suitable for heavy hydrocarbon feeds such as whole crude, atmospheric gas oil and atmospheric gas oil residua and especially vacuum gas oil and vacuum gas oil residua. Such feeds are normally, i.e. at ambient conditions, liquid, gelatinous or solid. Since coking tendency increases with molecular weight, in conventional steam cracking heavy hydrocarbons are highly coking feeds so that frequent decoking of the pyrolysis tubes is necessary, which is costly, and in fact residual cannot be cracked with commercially acceptable run lengths. Therefore, feasibility and economics are most favorable for such raw materials in the subject process. The process may also be used on naphtha.

Under the reaction conditions the heavy feeds may be vapor-liquid mixtures, viz., there is always vapo present which carries the liquid entrained with it.

Coke deposited on the recirculating particles may be burned off, viz. used as fuel in the solids heating system, or gasified to synthesis gas ($CO/H_2$ mixture) or low BTU gas. Since the process uncouples the firing zone from the reactor, it can run on less desirable fuels, for example waste gas, pitch or coal. This is in contradistinction to a conventional steam cracker in which the pyrolysis tubes are located in the radiant section of a furnace where the fuel is burned and combustion products of high sulfur liquids or of coal, e.g. coal ash, could be harmful to the metal tubes.

From an economic viewpoint it is preferable not to add an inert diluent, e.g. steam, to the reaction mixture; or to add only enough to assist in vaporization. However, one may dilute the hydrocarbon feed with steam because lower hydrocarbon partial pressure improves the selectivity of the cracking reaction to ethylene, diolefins and acetylenes. The weight ratio of steam to hydrocarbon may be in the range of about 0.01/1 to 6/1, preferably 0.1/1 to 1.

Further aspects of the invention concern modes of gas/solids separation and product gas quenching, and equipment useful for accomplishing the process.

A reactor is used which is not particularly limited as to shape and may be cylindrical but preferably is substantially rectangular in cross-section, viz. it may be rectangular or rounded at the corners, e.g. to an oval shape; or one may use as a design a rectangular form bent into a ring-like or annular shape where the solids and feed pass through the annulus. The reactor may be provided with openings along one end for introduction of feed gas, or one entire end may simply be a large opening. For solids/gas separation, preferably an inertial type, viz. a tee separator is used. The solids impact against themselves (a steady-state level of solids builds up in the tee separator) and drop by gravity out of the gas stream. Residence time in the separator can be kept very low (<10 ms). Separator efficiency is dependent on several factors, including reactor/separator geometry, relative gas/solids velocity, and particle mass. Judicious selection of these variables can result in separator efficiencies of 90+%, viz. 95+%, being obtainable.

The length of path that the solids must traverse before being removed from product gas, is selected wtih reference to the desired gas residence time in the reactor and the targeted solids velocity at removal, these two criteria being compatible and directionally similar as discussed above. Thus, the reactor length—which sets the length of path—is sized to allow acceleration of the solids to a velocity in a desirable range at which their erosive force is minimized.

FIG. 1 is a block flow diagram showing one embodiment of the general layout of the process. As shown, feed and optionally dilution steam are passed to the feed preheat section and heated and the effluent thereof is passed to the reaction section. The reaction section also receives hot particulate solids from the solids reheat section and returns cool solids thereto for reheating. The reaction effluent is passed to the effluent quench and heat recovery section and cooled effluent is sent to fractionation. On the energy side, fuel and air are passed to the solids reheat section and burned for reheating the cool solids (however, it should be noted that the coke laid down on the circulating particles may provide much or all of the fuel) and the flue gas thereof is sent to the flue gas heat recovery section, thence to the atmosphere. The flue gas heat recovery section heats boiler feed water (BFW) which is passed as quench fluid to the effluent quench and heat recovery section as direct or indirect quench; in case of the latter, high pressure steam is generated and recovered, as shown. High pressure steam may also be generated in and recovered from the flue gas heat recovery section. Although feed preheat is shown as a separate section, it may in fact utilize flue gas heat and thus be part of the flue gas heat recovery section.

Figure 2:
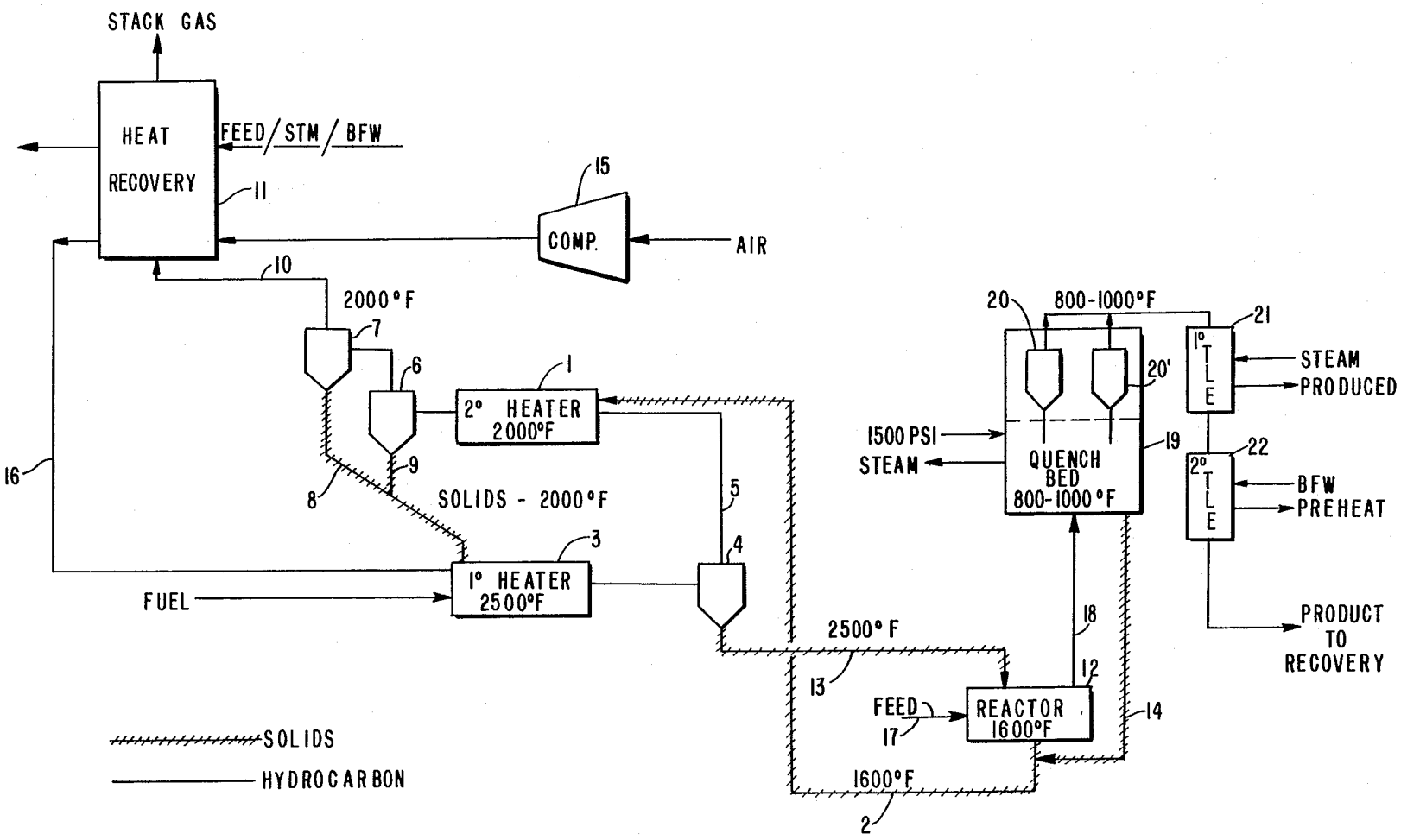
FIG. 2 is a schematic representation of one embodiment of the process of this invention.

FIG. 2 shows one sequence of operations useful for carrying out the process of the invention. Temperatures of the streams are shown by way of example. Thus the following description is illustrative only and not limitative.

The process utilizes 1600°-2500° .F circulating solids to provide heat for the cracking reaction. The solids are preferably an inert, refractory material such as alumina or may be coke or catalytic solids. The process, as shown in FIG. 2, consists of three main sections: the solids heating system, the reactor, and the quench system.

The solids heating system provides up to 2500° F. particles (50-300 μ, 5-30 lb./lb. feed) as a heat source for the cracking reaction. The hot solids and preheated hydrocarbon feed are contacted in a reactor for 10-40, preferably 10-20 ms resulting in a near equilibrium temperature of 1600°-2200° F. The exit temperature varies depending upon solids/gas ratio and inlet gas and solids temperatures. The solids/gas are then separated as they exit the reactor, with the solids being recirculated to the solids handling system for reheating. The cracked gas is rapidly quenched to a non-reacting temperature and then cooled further in a conventional quench system. Quenching of the reactor effluent in less than 10 ms can be achieved using direct quench, or indirect quench in a fluid bed.

In one approach, the particulate solids are heated in countercurrently staged refractory lined vessels. Hot combustion gases under pressure, e.g. 30 to 40 psia, entrain the solids and heat them from 1600° F. to 2500° F. in a staged system.

As shown in FIG. 2, one heater 1 (secondary) takes the solids via line 2 from 1600° to 2000° F. and the other 3 boosts the temperature to 2500° F.. The secondary heater uses the flue gas from the primary heater taken from the separator 4 via line 5, as a heat source. Coke on the solids is an additional source of fuel and burning off of the coke provides additional heat. The solids from the secondary heater are then separated in separators 6, 7 and gravity fed to the primary heater via lines 8, 9. The separators may be, e.g. refractory lined cyclones. Flue gas leaving the secondary heater at e.g. 2000° F. by line 10, undergoes heat recovery in heat recovery facilities 11. The primary and secondary heaters in this illustration heat the solids to 2500° F. before returning them to the reactor 12 via separator 4 then line 13, by gravity. Air compressed by compressor 15 and preheated by exchange in 11 is passed by line 16 to the primary heater 3 and burned with fuel. The heat recovery facilities 11 may perform various heating services, viz. in addition to or instead of heating compressed air, they may be used to preheat hydrocarbon feed or to heat steam or boiler feed water for the quench system or for other services needing high temperature.

Figure 3A:
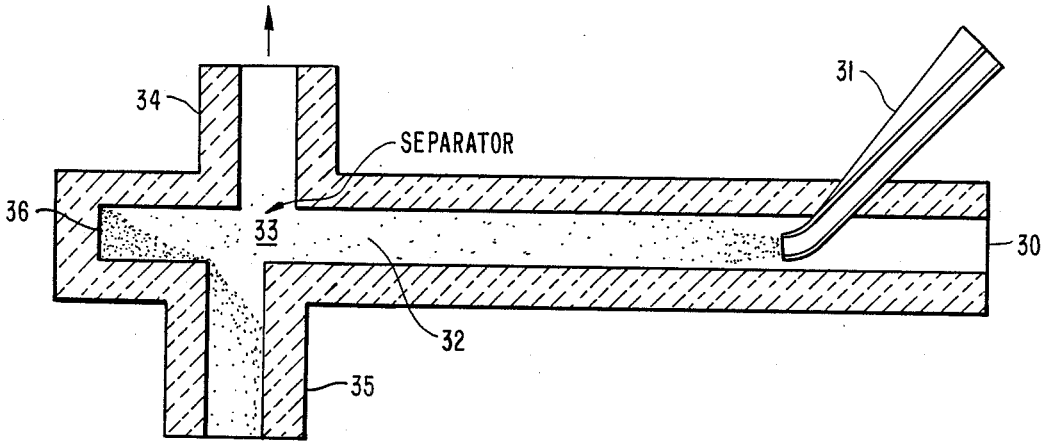
FIG. 3*a* shows a side elevation of a reactor having a double tee separator useful in the process and FIG. 3*b* shows a front end thereof in perspective.

The hydrocarbon feed, suitably preheated to about 1200° F. is introduced by line 17 into the reactor 12, as also are the solids at about 2500° F. by line 13. The hot refractory particles rapidly heat up and crack the feed. The solids are separated at the end of the reactor using the impact separator as illustrated in FIG. 3*a*. The 1600° F. reactor effluent resulting from the endothermic cracking reaction is then sent to quench and the solids recycled for partial or complete burning of the coke deposited on them in the reaction and reheated. A solids-to-gas weight ratio of about 6/1 in this illustration maintains the 1600° F. exit temperature. Residence times of 10–40 ms can be achieved due to the rapid heat transfer and separation between gas and solid.

Quenching of the reactor effluent may be carried out in an indirectly cooled fluid bed. The fluid bed consists of entrained solids fluidized by the product gas which rapidly conduct heat from the vaporous effluent to the cooling coils. A portion of solids is purged by line 14 to control the level of the quench bed and returned to line 2. Further heat recovery is accomplished in TLE's (transfer line heat exchangers) and/or a direct quench system. The fluid bed quenches the product gas from about 1600° F. to about 800° to 1000° F. at a rate of $\sim 10^{5}$° F./sec. The heat removal coils in the bed generate 600 to 2000 psi steam, e.g. high pressure 1500 psi steam. Solids entrained in the product as are separated in cyclones located in the disengagement area above the bed. Then the product gas may be directly quenched with gas oil or alternatively enters conventional TLE's which respectively generate steam and preheat BFW in cooling the gas from 800°–1000° F. to e.g. about 350° to 700° F. Any heavy materials or water in the stream are then condensed in a conventional fractionator or quench system and the resulting cracked gas, at about 100° F., is sent to process gas compression.

Thus reactor effluent is passed by line 18 preferably into quench bed 19 where it is rapidly cooled by indirect heat exchange by means of heat removal coils (not shown) in the bed which generate high pressure steam. Residual entrained solids are separated by separating means, preferably in cyclones 20,20'. The effluent then flows into one to three or more TLE's, in this instance TLE's 21 and 22 before passing to the product recovery section.

The fluid bed system simplifies downstream separation by keeping the quench fluid separate from the product stream and allows for further solids separation (entrained solids), e.g. via the cyclones.

Figure 3B:
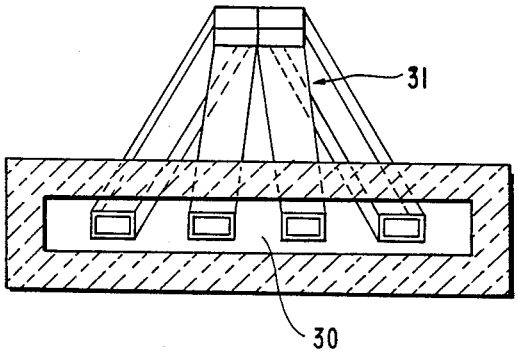

The configuration of a reactor with a double tee separator may be seen from FIGS. 3*a* and 3*b*. The integral reactor/separator may be a slot-shaped, refractory-lined unit which provides for gas/solids contact and separation. As shown, see FIG. 3*b*, the reactor inlet 30 may be a single slot of rectangular cross-section for introducing hydrocarbon feed at one end, taking up the width of the reactor; the solids and feed gas flow lengthwise thereof. A contactor 31 is used to feed heated particulate solids preferably by gravity into the reactor in a manner to distribute them through the gas. The reactor may be oriented in any desired direction, for instance it has a substantially horizontal run 32 for passage of solids and gas. The separator 33 in the run 32 of the reactor is formed for instance with a tee having a branch 34 for gas removal and a tee having a branch 35 oriented vertically downwards for solids removal. As shown, the branch 34 is upstream of the branch 35. A direct quench fluid may be injected into the gas exit line 34 in lieu of an indirect quench system.

Suitable dimensions for the reactor/separator are: length L=4–7 ft., width W=1–20, preferably 3–10 ft. and height H=3 to 24 inches, e.g. $\sim\frac{1}{2}$ ft.

In operation, gas and particles pass lengthwise of the reactor; they flow into the run 32 of the reactor and into the two tees in series. Product gas flows out in the branch 34 of the first tee whereas particles continue moving substantially straight ahead. Particles impact directly against the reactor wall 36 or, at steady state, come to rest against a layer of deposited particles in the second tee and fall downward into the branch 35 of that tee, to be recycled. It may be noted that the gas, in order to enter the branch 34, is only required to change direction by about 90°. By contrast, in the known TRC process, see U.S. Pat. No. 4,318,800, the gas must change direction by 180°. In turning 180° the flow is reversed and the gas will be moving much more slowly, using up additional residence time at reaction conditions. Additionally the gas, in making such a turn, blows across the face of solids which gives them a tendency to be re-entrained thereby reducing separation efficiency.

Figure 3C:
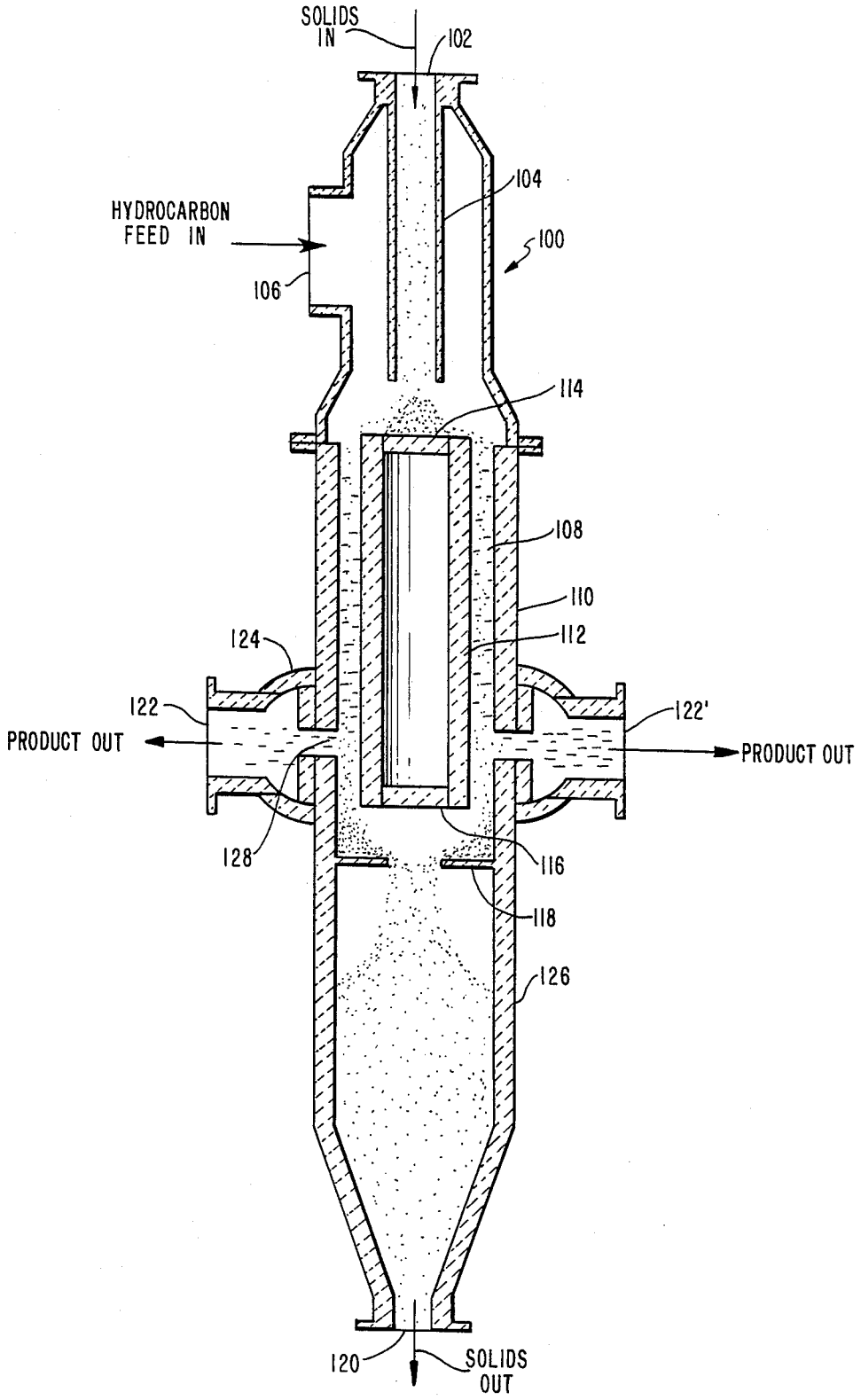
FIG. 3*c* shows a vertical section of an integral reactor/separator having an annular configuration.

FIG. 3*c* illustrates another type of reactor/separator. FIG. 3*c* shows a vertically oriented reactor/separator suitably of ceramic material, having an annular reaction section. A housing in the form of a cylindrical chamber 100 has an opening 102 in which a solids feed pipe 104 is inserted. Inlet 106 is provided in the upper portions of the chamber for introducing hydrocarbon feed. The housing 100 is made in two separate parts, in alignment, comprising an upper wall portion 110 and a lower wall portion 126 which are bracketed and supported by a torus 124. An annulus 108 which constitutes the reaction section is formed by the wall portion 110 of the cylindrical chamber and an internal closed surface such as an internal cylinder 112 closed off to solids and gas by a plate 114 at the top and an end piece 116. The inner cylinder 112 is attached to the wall portion 110 by a series of connecting pieces (not shown) which permit flow of solids and gas through the annulus. As separator, a continuous circular passageway or gap 128 between the two wall portions, at about a 90° angle from the axis of the annular reaction section 108 and in communication therewith, allows exit of product gas and communicates with a plurality of outlets, viz., 122, 122' of the torus 124. Alternatively, the housing can be a one-piece construction with openings for product gas in alignment with the outlets of the torus. Below the reaction section an element such as a circular plate or ledge 118 is provided where solids particles will impact. An opening 120 at the bottom of the cylindrical chamber 100 allows solids removal.

In operation, hydrocarbon feed and solid particles flow concurrently downward through the annular reaction section 108 and react. Separation takes place as follows. Product gas, making a turn of about 90°, flows out through the passageway 128 then through outlets 122, 122' whereas particles continue moving substantially straight ahead. Particles impact directly against the ledge 118 or, at steady state, come to rest against a layer of deposited particles, fall downward to the bottom of the chamber and flow out through opening 120, to be recycled. Product gas is sent to quench.

The invention is illustrated in the following examples. Particulate solids outlet velocity was calculated for Run No. 74-1-2 in Table 1 and was found to be substantially below gas exit velocity.

DESCRIPTION OF PILOT UNIT AND EXPERIMENTS

A pilot unit was constructed for the purpose of carrying out the solids/hydrocarbon interaction to provide product yields and time-temperature relationships for particular feedstocks. Operation of the unit consists of contacting the preheated hydrocarbon feed and steam dilution with hot solids particles at a Y-piece junction, with the resultant gas and solids mixture flowing into a 0.37 inch ID×18 inch long reactor tube. The desired residence time and hydrocarbon partial pressure are achieved by varying the hydrocarbon feedrate and dilution rate. The preheated feed or feed/stream mixture temperature at the contact area is kept sufficiently low to prevent significant cracking before contact with the solids, that is, approximately less than 5 wt. % $C_3$−conversion. The preheated hydrocarbon feed may be in either vapor or vapor-liquid mixture form at the contact area. The cracked gas and solids mixture at the end of the reactor tube is quenched with steam to stop the reaction, that is, bring the temperature of the mixture below 500° C. A gas slipstream is sent to a sample collection system, where the $C_5$+material is condensed and the $C_4$−gas stream collected in a sample bomb. The $C_4$−components are obtained via gas chromatograph analysis, and the $C_5$+component is calculated by a combination of a hydrogen balance method and a tracer material balance method.

Desired reaction severity is achieved by varying the flowrate and temperature of the solids at the contact area. The solids particles are uniformly metered to the contact area from a heated, fluidized bed through a transfer pipe by means of controlling pressure drop across a restriction orifice located in the transfer pipe.

| | Feed Characteristics | | |
|---|---|---|---|
| Feedstock | Naphtha | HVGO (Heavy Vacuum Gas Oil) | Residua |
| Source | Catalytic Reformer Feed | Vacuum PS (pipestill) Sidestream | Atmospheric PS (pipestill) Bottoms |
| IBP, °C. | 88 | 377 | — |
| FBP, °C. | 182 | 564 | — |
| MABP, °C. (Mean Average Boiling Point) | 127 | 506 | — |
| Molecular Wt. | 116 | 550 | 1000 |
| Hydrogen Content, wt. % | 14 | 12 | 11 |
| Sulfur, wppm | 240 | 11,700 | — |
| Density, g/cc @ 60° F. | 0.748 | 0.923 | 0.881 |
| Appearance @ 60° F. | Liquid | Solid Gel | Solid Gel |
| Color @ 60° F. | Clear | Brown | Black |

Solids particle size and type: 250μ (60 mesh), alumina

TABLE 1

HVGO Feed
Summary of Operating Conditions
High Steam Dilution (0.3 S/HC Weight Ratio)

| | | | | | | |
|---|---|---|---|---|---|---|
| Ethylene Yield, wt. % | 22.7 | 24.0 | 23.8 | 22.9 | 24.2 | 24.8 |
| Methane Yield, wt. % | 7.7 | 8.2 | 8.4 | 8.6 | 9.8 | 10.6 |
| Feedrate, lb/hr | 3.35 | 3.35 | 3.35 | 3.35 | 3.35 | 3.35 |
| Steam Rate, lb/hr | 1.0 | 1.0 | 1.0 | 1.0 | 1.0 | 1.0 |
| Steam/HC | 0.3 | 0.3 | 0.3 | 0.3 | 0.3 | 0.3 |
| Solids Rate, lb/hr | 78 | 97 | 105 | 126 | 144 | 125 |
| Solids/HC | 23.3 | 29.0 | 31.3 | 37.6 | 43.0 | 37.3 |
| Fluid Bed Temp, °C. | 1165 | 1177 | 1168 | 1164 | 1169 | 1204 |
| Solids Inlet Temp, °C. | 1004 | 1045 | 1026 | 1043 | 1055 | 1066 |
| Reactor Skin Temp Profile: | | | | | | |
| @ 0" °C. | 750 | 764 | 762 | 734 | 770 | 819 |
| @ 1" °C. | 750 | 720 | 761 | 731 | 797 | 785 |
| @ 3" °C. | 828 | 786 | 849 | 831 | 887 | 875 |
| @ 5" °C. | 856 | 830 | 882 | 878 | 927 | 923 |
| @ 7" °C. | 858 | 843 | 884 | 882 | 939 | 939 |
| @ 9" °C. | 866 | 850 | 887 | 887 | 946 | 944 |
| @ 11" °C. | 852 | 838 | 876 | 873 | 926 | 932 |
| Preheated Feed Temp, °C. | 449 | 547 | 444 | 442 | 449 | 530 |
| Reactor Inlet Press, kpag | 0.5 | 2.0 | 1.0 | 2.0 | 4.0 | 5.0 |
| Reactor Outlet Press, kpag | 0.0 | 0.2 | 0.0 | 0.0 | 0.0 | 0.5 |
| Reactor θ, (residence time) msec | 25 | 24 | 23 | 23 | 22 | 21 |
| HCPP-inlet, psia (hydrocarbon partial pressure | 1.1 | 1.1 | 1.1 | 1.1 | 1.1 | 1.1 |
| HCPP-outlet, psia | 7.7 | 7.9 | 7.9 | 8.0 | 8.2 | 8.4 |
| Velocity, ft/sec: | | | | | | |
| Gas Inlet | 28.4 | 32.8 | 29.0 | 28.6 | 28.3 | 31.5 |
| Gas Outlet | 87.4 | 90.8 | 94.1 | 96.0 | 103.5 | 102.4 |
| Solids Inlet | <5 | <5 | <5 | <5 | <5 | <5 |
| Run Number | 108-4-5 | 74-3-5 | 108-3-3 | 108-2-2 | | |
| Duplicate Sample | | | 108-3-4 | | 108-1-1 | 74-1-2 |

TABLE 2

HVGO Feed
Summary of Operating Conditions
Low Steam Dilution (0.1 S/HC)

| | | | | |
|---|---|---|---|---|
| Ethylene Yield, wt. % | 20.2 | 21.1 | 23.8 | 24.6 |
| Methane Yield, wt. % | 6.4 | 7.0 | 9.0 | 9.6 |
| Feedrate, lb/hr | 6.0 | 6.0 | 6.0 | 6.0 |
| Steam Rate, lb/hr | 0.6 | 0.6 | 0.6 | 0.6 |
| Steam/HC | 0.1 | 0.1 | 0.1 | 0.1 |
| Solids Rate, lb/hr | 124 | 95 | 125 | 150 |
| Solids/HC | 20.7 | 15.8 | 20.8 | 25.0 |
| Fluid Bed Temp, °C. | 1193 | 1177 | 1204 | 1204 |
| Solids Inlet Temp, °C. | 1029 | 1028 | 1071 | 1086 |
| Reactor Skin Temp Profile: | | | | |
| @ 0" °C. | 799 | 775 | 800 | 792 |
| @ 1" °C. | 732 | 710 | 775 | 780 |
| @ 3" °C. | 779 | 740 | 832 | 850 |
| @ 5" °C. | 806 | 760 | 854 | 877 |

TABLE 2-continued

HVGO Feed
Summary of Operating Conditions
Low Steam Dilution (0.1 S/HC)

| | | | | |
|---|---|---|---|---|
| @ 7" | 808 | 755 | 861 | 888 |
| @ 9" | 804 | 756 | 865 | 898 |
| @ 11" | 793 | 745 | 840 | 871 |
| Preheated Feed Temp, °C. | 545 | 543 | 539 | 508 |
| Reactor Inlet Press, kpag | 5.0 | 3.0 | 6.0 | 9.0 |
| Reactor Outlet Press, kpag | 0.0 | 0.0 | 0.5 | 0.5 |
| Reactor θ, (residence time) msec | 25 | 25 | 22 | 22 |
| HCPP-inlet, psia (hydro-carbon partial pressure | 2.5 | 2.5 | 2.6 | 2.6 |
| HCPP-outlet, psia | 10.5 | 10.6 | 11.0 | 11.1 |
| Velocity, ft/sec: | | | | |
| Gas Inlet | 25.2 | 25.7 | 24.8 | 23.2 |
| Gas Outlet | 101.0 | 99.7 | 119.3 | 127.2 |
| Solids Inlet | <5 | <5 | <5 | <5 |
| Run Number | 82-2-4 | 82-3-5 | 82-2-2 | 82-1-1 |

TABLE 3

HVGO Feed
Summary of Operating Conditions
Very Low Steam Dilution (0.025 S/HC)

| | | | |
|---|---|---|---|
| Ethylene Yield, wt. % | 22.2 | 23.2 | 22.5 |
| Methane Yield, wt. % | 9.4 | 9.6 | 10.0 |
| Feedrate, lb/hr | 6.0 | 6.0 | 6.0 |
| Steam Rate, lb/hr | 0.15 | 0.15 | 0.15 |
| Steam/HC | 0.025 | 0.025 | 0.025 |
| Solids Rate, lb/hr | 100 | 125 | 121 |
| Solids/HC | 16.7 | 20.8 | 20.2 |
| Fluid Bed Temp, °C. | 1186 | 1199 | 1188 |
| Solids Inlet Temp, °C. | 1064 | 1065 | 1044 |
| Reactor Skin Temp Profile: | | | |
| @ 0" | 755 | 788 | 770 |
| @ 1" | 753 | 763 | 773 |
| @ 3" | 836 | 824 | 843 |
| @ 5" °C. | 865 | 831 | 887 |
| @ 7" | 860 | 827 | 885 |
| @ 9" | 863 | 831 | 899 |
| @ 11" | 845 | 824 | 892 |
| Preheated Feed Temp, °C. | 541 | 549 | 541 |
| Reactor Inlet Press, kpag | 3.0 | 3.0 | 5.0 |
| Reactor Outlet Press, kpag | 1.0 | 0.0 | 1.0 |
| Reactor θ, (residence time) msec | 29 | 29 | 28 |
| HCPP-inlet, psia (hydro-carbon partial pressure | 4.0 | 4.0 | 4.1 |
| HCPP-outlet, psia | 12.5 | 12.4 | 12.6 |
| Velocity, ft/sec: | | | |
| Gas Inlet | 15.9 | 16.0 | 15.5 |
| Gas Outlet | 106.5 | 106.2 | 115.0 |
| Solids Inlet | <5 | <5 | <5 |
| Run Number | 98-3-3 | 90-1-1 | 98-2-2 |
| Duplicate Sample | 99-3-4 | | |

TABLE 4

HVGO Feed
Summary of Operating Conditions
Low Solids Temp/High Solids Rate Test
Low Steam Dilution (0.1 S/HC)

| | | | | | |
|---|---|---|---|---|---|
| Ethylene Yield, wt. % | 21.9 | 22.5 | 23.3 | 23.0 | 23.7 |
| Methane Yield, wt. % | 7.25 | 7.62 | 7.97 | 7.93 | 8.42 |
| Feedrate, lb/hr | 6.0 | 6.0 | 6.0 | 6.0 | 6.0 |
| Steam Rate, lb/hr | 0.6 | 0.6 | 0.6 | 0.6 | 0.6 |
| Steam/HC | 0.1 | 0.1 | 0.1 | 0.1 | 0.1 |
| Solids Rate, lb/hr | 166 | 166 | 208 | 208 | 250 |
| Solids/HC | 27.7 | 27.7 | 34.7 | 34.7 | 41.7 |
| Fluid Bed Temp, °C. | 1090 | 1093 | 1093 | 1093 | 1088 |
| Solids Inlet Temp, °C. | 965 | 994 | 977 | 985 | 980 |
| Reactor Skin Temp Profile: | | | | | |
| @ 0" | 694 | 690 | 700 | 690 | 690 |
| @ 1" | 705 | 700 | 718 | 720 | 725 |
| @ 3" | 755 | 780 | 799 | 800 | 807 |
| @ 5" °C. | 784 | 813 | 835 | 840 | 840 |

TABLE 4-continued

HVGO Feed
Summary of Operating Conditions
Low Solids Temp/High Solids Rate Test
Low Steam Dilution (0.1 S/HC)

| | | | | | |
|---|---|---|---|---|---|
| @ 7" | 803 | 830 | 852 | 861 | 857 |
| @ 9" | 820 | 850 | 870 | 892 | 870 |
| @ 11" | 832 | 828 | 856 | 880 | 858 |
| Preheated Feed Temp, °C. | 529 | 526 | 546 | 526 | 532 |
| Reactor Inlet Press, kpag | 7.0 | 7.0 | 10.0 | 10.0 | 12.0 |
| Reactor Outlet Press, kpag | 0.5 | 0.5 | 1.0 | 1.0 | 1.0 |
| Reactor θ, (residence time) msec | 25 | 25 | 24 | 24 | 24 |
| HCPP-inlet, psia (hydro-carbon partial pressure) | 2.6 | 2.6 | 2.7 | 2.7 | 2.7 |
| HCPP-outlet, psia | 10.7 | 10.8 | 10.9 | 10.9 | 11.0 |
| Velocity, ft/sec: | | | | | |
| Gas Inlet | 24.2 | 24.1 | 24.1 | 23.5 | 23.9 |
| Gas Outlet | 108.4 | 110.2 | 113.0 | 113.3 | 113.0 |
| Solids Inlet | <5 | <5 | <5 | <5 | <5 |
| Run Number | 78-1-5 | 78-1-1 | 78-2-4 | 78-2-2 | 78-3-3 |

TABLE 5

Residua Feed (Atm. PS Bottoms)
Summary of Operating Conditions
High Steam Dilution (0.3 S/HC)
Vapor Feed Injection to Reactor

| | | | | |
|---|---|---|---|---|
| Ethylene Yield, wt. % | 14.2 | 17.2 | 20.3 | 21.2 |
| Methane Yield, wt. % | 5.15 | 5.99 | 7.94 | 9.85 |
| Feedrate, lb/hr | 5.0 | 5.0 | 5.0 | 5.0 |
| Steam Rate, lb/hr | 1.5 | 1.5 | 1.5 | 1.5 |
| Steam/HC | 0.3 | 0.3 | 0.3 | 0.3 |
| Solids Rate, lb/hr | 43 | 76 | 105 | 173 |
| Solids/HC | 8.6 | 15.2 | 21.0 | 34.6 |
| Fluid Bed Temp, °C. | 1182 | 1192 | 1191 | 1192 |
| Solids Inlet Temp, °C. | 814 | 964 | 1047 | 1080 |
| Reactor Skin Temp Profile: | | | | |
| @ 0" | 505 | 572 | 639 | 665 |
| @ 1" | 440 | 448 | 532 | 651 |
| @ 3" | 533 | 628 | 729 | 823 |
| @ 5" °C. | 540 | 670 | 759 | 870 |
| @ 7" | 549 | 687 | 773 | 878 |
| @ 9" | 561 | 704 | 785 | 874 |
| @ 11" | 561 | 695 | 770 | 834 |
| Preheated Feed Temp, °C. | 545 | 533 | 516 | 546 |
| Reactor Inlet Press, kpag | 26.0 | 22.0 | 29.0 | 27.0 |
| Reactor Outlet Press, kpag | 1.0 | 2.0 | 0.0 | 1.0 |
| Reactor θ, (residence time) msec | 28 | 24 | 21 | 19 |
| HCPP-inlet, psia (hydro-carbon partial pressure) | 0.8 | 0.8 | 0.9 | 0.9 |
| HCPP-outlet, psia | 7.1 | 7.6 | 8.0 | 8.8 |
| Velocity, ft/sec: | | | | |
| Gas Inlet | 32.7 | 30.8 | 28.5 | 28.5 |
| Gas Outlet | 81.5 | 100.4 | 120.0 | 143.3 |
| Solids Inlet | <5 | <5 | <5 | <5 |
| Run Number | 136-2-5 | 136-1-3 | 140-2-3 | 140-1-1 |

TABLE 6

Residua Feed (Atm. PS Bottoms)
Summary of Operating Conditions
High Steam Dilution (0.3 S/HC)
Liquid Feed Injection to Reactor

| | | | |
|---|---|---|---|
| Ethylene Yield, wt. % | 14.3 | 15.8 | 16.4 |
| Methane Yield, wt. % | 4.6 | 4.8 | 5.1 |
| Feedrate, lb/hr | 5.0 | 5.0 | 5.0 |
| Steam Rate, lb/hr | 1.5 | 1.5 | 1.5 |
| Steam/HC | 0.3 | 0.3 | 0.3 |
| Solids Rate, lb/hr | 80 | 125 | 135 |
| Solids/HC | 16.0 | 25.0 | 27.0 |
| Fluid Bed Temp, °C. | 1112 | 1193 | 1195 |
| Solids Inlet Temp. °C. | 1014 | 1048 | 1061 |
| Reactor Skin Temp Profile: | | | |

TABLE 6-continued

Residua Feed (Atm. PS Bottoms)
Summary of Operating Conditions
High Steam Dilution (0.3 S/HC)
Liquid Feed Injection to Reactor

| | | | |
|---|---|---|---|
| @ 0" °C. | 648 | 608 | 614 |
| @ 1" °C. | 566 | 451 | 462 |
| @ 3" °C. | 642 | 648 | 656 |
| @ 5" °C. | 750 | 770 | 781 |
| @ 7" °C. | 738 | 802 | 817 |
| @ 9" °C. | 740 | 813 | 824 |
| @ 11" °C. | 731 | 796 | 808 |
| Preheated Feed Temp, °C. | 370 | 375 | 375 |
| Reactor Inlet Press, kpag | 15.0 | 20.0 | 20.0 |
| Reactor Outlet Press, kpag | 0.5 | 1.0 | 1.0 |

TABLE 6-continued

Residua Feed (Atm. PS Bottoms)
Summary of Operating Conditions
High Steam Dilution (0.3 S/HC)
Liquid Feed Injection to Reactor

| | | | |
|---|---|---|---|
| Reactor θ, (residence time) msec | 22 | 22 | 22 |
| HCPP-inlet, psig (hydrocarbon partial pressure) | 0.8 | 0.8 | 0.8 |
| HCPP-outlet, psia | 7.0 | 7.2 | 7.3 |
| Velocity, ft/sec: | | | |
| Gas Inlet | 43.2 | 39.6 | 39.9 |
| Gas Outlet | 99.7 | 107.4 | 109.9 |
| Solids Inlet | <5 | <5 | <5 |
| Run Number | 120-1-1 | 132-1-2 | 132-1-1 |

TABLE 7

Naphtha Feed
Summary of Operating Conditions
Low Steam Dilution (0.1 S/HC)

| | | | | | | | |
|---|---|---|---|---|---|---|---|
| Ethylene Yield, wt. % | 24.6 | 24.6 | 29.6 | 31.6 | 29.7 | 30.4 | 32.3 |
| Methane Yield, wt. % | 7.5 | 7.4 | 9.1 | 10.5 | 10.8 | 11.4 | 14.3 |
| Feedrate, lb/hr | 7.5 | 7.5 | 7.5 | 7.5 | 10.0 | 10.0 | 5.64 |
| Steam Rate, lb/hr | 0.75 | 0.75 | 0.75 | 0.75 | 1.0 | 1.0 | 0.75 |
| Steam/HC | 0.1 | 0.1 | 0.1 | 0.1 | 0.1 | 0.1 | 0.133 |
| Solids Rate, lb/hr | 127 | 127 | 190 | 200 | 250 | 250 | 185 |
| Solids/HC | 16.9 | 16.9 | 25.3 | 26.7 | 25.0 | 25.0 | 32.8 |
| Fluid Bed Temp, °C. | 1188 | 1188 | 1193 | 1204 | 1196 | 1196 | 1204 |
| Solids Inlet Temp, °C. | N/A | N/A | N/A | N/A(1) | N/A | N/A | N/A(1) |
| Reactor Skin Temp Profile: | | | | | | | |
| @ 0" °C. | 809 | 813 | 826 | 823 | 770 | 767 | 761 |
| @ 1" °C. | 692 | 689 | 762 | 756 | 734 | 729 | 760 |
| @ 3" °C. | 775 | 765 | 855 | 870 | 873 | 867 | 910 |
| @ 5" °C. | 800 | 793 | 876 | 891 | 903 | 904 | 945 |
| @ 7" °C. | 803 | 796 | 877 | 891 | 906 | 898 | 945 |
| @ 9" °C. | 809 | 804 | 882 | 898 | 912 | 912 | 962 |
| @ 11" °C. | 795 | 790 | 869 | 871 | 891 | 905 | 938 |
| Preheated Feed Temp, °C. | 621 | 627 | 621 | 616 | 611 | 629 | 689 |
| Reactor Inlet Press, kpag | 10.0 | 7.0 | 18.0 | 18.0 | 17.0 | 19.0 | 10.0 |
| Reactor Outlet Press, kpag | 1.0 | 2.0 | 0.0 | 0.0 | 3.0 | 3.0 | 2.0 |
| Reactor θ, (residence time) msec | 10 | 10 | 9 | 9 | 13 | 13 | 17 |
| HCPP-inlet, psia (hydrocarbon partial pressure) | 3.5 | 3.4 | 3.7 | 3.7 | 8.6 | 8.6 | 6.5 |
| HCPP-outlet, psia | 6.9 | 7.0 | 7.2 | 7.6 | 11.9 | 11.9 | 11.1 |
| Velocity, ft/sec: | | | | | | | |
| Gas Inlet | 119.7 | 123.9 | 111.7 | 111.2 | 63.3 | 65.0 | 51.6 |
| Gas Outlet | 151.9 | 151.2 | 182.8 | 201.5 | 156.5 | 161.0 | 120.5 |
| Solids Inlet | <5 | <5 | <5 | <5 | <5 | <5 | <5 |
| Run Number | 48-21-4 | 48-2-3 | 48-1-5 | 48-1-2 | 56-2-2 | 56-2-3 | 44-1-3 |

(1) Solids inlet temp. estimated 120° C. below fluid bed temp. which was used for heating the solids.

TABLE 8

Naphtha Feed
Summary of Operating Conditions
High Steam Dilution (0.35 S/HC)

| | | | | | |
|---|---|---|---|---|---|
| Ethylene Yield, wt. % | 29.6 | 31.5 | 31.9 | 28.9 | 29.4 |
| Methane Yield, wt. % | 10.1 | 10.9 | 11.1 | 9.7 | 10.0 |
| Feedrate, lb/hr | 6.0 | 6.0 | 6.0 | 4.75 | 4.75 |
| Steam Rate, lb/hr | 2.1 | 2.2 | 2.2 | 1.75 | 1.75 |
| Steam/HC | 0.345 | 0.367 | 0.367 | 0.367 | 0.367 |
| Solids Rate, lb/hr | 150 | 150 | 150 | 120 | 120 |
| Solids/HC | 25.0 | 25.0 | 25.0 | 25.3 | 25.3 |
| Fluid Bed Temp, °C. | 1204 | 1199 | 1196 | 1193 | 1193 |
| Solids Inlet Temp, °C. | N/A | N/A | N/A | N/A | N/A(1) |
| Reactor Skin Temp Profile: | | | | | |
| @ 0" °C. | 783 | 755 | 759 | 794 | 801 |
| @ 1" °C. | 720 | 726 | 730 | 719 | 734 |
| @ 3" °C. | 840 | 864 | 893 | 818 | 833 |
| @ 5" °C. | 862 | 896 | 905 | 845 | 854 |
| @ 7" °C. | 865 | 898 | 900 | 847 | 854 |
| @ 9" °C. | 872 | 905 | 909 | 853 | 860 |
| @11" °C. | 858 | 886 | 895 | 827 | 843 |
| Preheated Feed Temp, °C. | 647 | 675 | 694 | 702 | 706 |
| Reactor Inlet Press, kpag | 9.0 | 11.0 | 11.0 | 5.0 | 4.0 |
| Reactor Outlet Press, kpag | 1.0 | 1.0 | 1.0 | 1.0 | 1.0 |
| Reactor θ, (residence | 13 | 12 | 12 | 15 | 15 |

TABLE 8-continued

| Naphtha Feed Summary of Operating Conditions High Steam Dilution (0.35 S/HC) | | | | | |
|---|---|---|---|---|---|
| time) msec | | | | | |
| HCPP-inlet, psia (hydrocarbon partial pressure) | 4.2 | 4.1 | 4.1 | 3.8 | 3.7 |
| HCPP-outlet, psia | 8.46 | 8.3 | 8.4 | 8.0 | 8.0 |
| Velocity, ft/sec: | | | | | |
| Gas Inlet | 81.1 | 87.2 | 88.4 | 76.2 | 77.2 |
| Gas Outlet | 125.1 | 149.1 | 151.0 | 109.7 | 111.7 |
| Solids Inlet | <5 | <5 | <5 | <5 | <5 |
| Run Number | 56-1-5 | 52-1-1 | 52-1-2 | 52-2-4 | 52-2-3 |
| Duplicate Sample | 56-1-1 | | | | |

(1) Solids inlet temp. estimated at 120° C. below fluid bed temp.

| Calculation of Particle Outlet Velocity for Run Number 74-1-2 of Table 1 | |
|---|---|
| Reactor Outlet Conditions | |
| Gas velocity | 102.4 ft./sec. |
| Gas viscosity | 0.030 centipoise |
| Gas molecular weight | 28.1 |
| Pressure | 1.005 kPa |
| Temperature | 944° C. |
| Particle diameter | 0.025 cm |
| Particle density | 2.5 g/cm$^3$ |
| Gas density | $3.09 \times 10^{-4}$ g/cm$^3$ |

Calculation assumes

1. Gas flows at outlet conditions of velocity, density, and viscosity throughout entire reactor. This assumption gives a higher particle exit velocity than would result in practice.

2. Friction effects of particles and gas at tube wall are negligible. This results in a higher exit velocity calculated than would result in practice.

3. Drag coefficient for gas on particle is for single isolated particle and contains no correction for the reduced drag which results from particle clustering. This results in a high calculated value of particle exit velocity. Use the method of C. E. Lapple and C. B. Shepherd, *Industrial and Engineering Chemistry,* vol. 32, pp. 605–617, May 1940.

Calculate $Re_o$, particle Reynolds number at particle injection point, before particle has accelerated $$Re_o = \frac{dV_o\rho}{\mu} = \frac{(0.025)(102.4 \times 30.48)(3.09 \times 10^{-4})}{(3.0 \times 10^{-4})} = 80.36$$

where $d$ = particle diameter
$V$ = slip velocity between gas and particle
$\rho$ = gas density
$\mu$ = gas viscosity
$V_o$ = initial slip velocity According to Table V of Lapple and Shepherd the relation between particle residence time and Reynolds number is $$\left(\frac{3\mu}{4\rho_p d^2}\right)t = \int_{Re}^{Re_o} \frac{dRe}{CRe^2} = \int_{Re}^{Re_b} \frac{dRe}{CRe^2} - \int_{Re_o}^{Re_b} \frac{dRe}{CRe^2}$$

-continued where $t$ = particle residence time to reach $Re$
$\rho_p$ = particle density
$C$ = coefficient of drag
$Re_b$ = arbitrary base Reynolds number Table II gives discrete value of $$\int_{Re}^{Re_b} \frac{dRe}{CRe^2}$$

for various value of Re. For example at Re=-$Re_o$=80.36 the value of the above integral is 0.01654 and for Re=50, the integral is 0.02214. Thus the residence time for the particle starting at $Re_o$ to reach Re is $$t = \left(\frac{4\rho_p d^2}{3\mu}\right)(0.02214 - 0.01654) = 0.0389 \text{ seconds}$$

The same calculation may be made for other Reynolds numbers. Recalling that the Reynolds numbers are defined in terms of slip velocity, V $=V_{gas}$ - Vparticle, particle velocity can then be calculated for each particle residence time. The distance traveled by the particle in time t is given by $$\int_{t=0}^{t} V \text{ particle } dt$$

which may be obtained graphically or by numerical technique. Discrete values are tabulated below:

TABLE 9

| Re | Slip Velocity ft./sec. | Particle Velocity ft./sec. | Particle Residence Time sec. | Distance Travelled, ft. |
|---|---|---|---|---|
| 80.36 | 102.4 | 0 | 0. | 0 |
| 70 | 89.6 | 12.8 | 0.01076 | 0.07 |
| 50 | 64 | 38.4 | 0.03888 | 0.83 |
| 30 | 38.4 | 64 | 0.0920 | 3.66 |

Interpolating from these values one can find that for a reactor 1.5 ft. long as in the pilot plant experiments, a particle exit velocity of 48 ft./sec. is achieved.

The following presents a comparison of the subject invention versus Gulf U.S. Pat. No. 4,097,363:

TABLE 10

PRODUCT YIELDS FOR TWO SIMILAR FEEDS AT EQUIVALENT METHANE MAKE

| Naphtha Feed | | | Heavy Gas Oil Feed | |
|---|---|---|---|---|
| Subject Invention | Gulf Patent | Products wt. % | Subject Invention | Gulf Patent |
| 10.1 | 10.1 | methane | 10.6 | 10.6 |
| 29.6 | 22.5 | ethylene | 24.8 | 21.5 |
| 2.0 | 0.7[1] | acetylene | 3.6 | 0.31 |
| 1.2 | 0.5 | hydrogen | 1.4 | 0.5 |
| 2.1 | 3.7 | ethane | 0.9 | 2.8 |
| 13.6 | 15.0 | propylene/ propadiene | 5.4 | 10.0 |
| 5.4 | 3.5 | . butadiene | 2.9 | 2.0 |
| 5.0 | 6.5 | other $C_4$- | 2.4 | 3.5 |
| 31.0 | 36.0 | $C_4$+ | 48 | 55.3 |
| trace | 1.5 | coke | | 3.0 |
| 100 | 100 | TOTAL | 100 | 100 |
| 56-1-1 | —— | Run # | 74-1-2 | — |

[1]Acetylene calculated by difference from FIG. 1A on Ultimate vs. Actual ethylene/ethane yield, based on stated 0.8 conversion factor.

TABLE 11

| | Operating Conditions: | | | |
|---|---|---|---|---|
| | Gulf Patent | | Subject Invention | |
| Feed Oil | Naphtha | Heavy Gas Oil | Naphtha | Heavy Gas Oil |
| Operating Conditions | | | | |
| Feed Preheat Temp. °F.(°C.) | 689(365) | 310(154) | (647° C.) | (530° C.) |
| Solids Preheat Temp. °F.(°C.) | 1816(985) | 1756(957) | (1080° C.) | (1066° C.) |
| Transfer line avg. temp. °F.(°C.) | 1537(836) | 1607(874) | | |
| Lower Riser Inlet Temp. °F.(°C.) | 1559(848) | 1675(913) | | |
| Upper Riser Outlet Temp. °F.(°C.) | 1529(832) | 1581(866) | | |
| Primary Quench Temp. °F.(°C.) | 1114(601) | 1192(644) | | |
| Steam to Feed Weight Ratio | 0.496 | 0.495 | 0.35 | 0.3 |
| Argon Diluent to feed weight ratio | 0.090 | 0.086 | 0.058 | 0.090 |
| Quench water to feed weight ratio | 0.222 | 0.375 | — | — |
| Solids to feed weight ratio | 10.0 | 10.6 | 25 | 37.3 |
| Reactor Pressure psia (kg/cm$^2$) | 24.32(1.7) | 24.17(1.69) | | |
| Reactor Velocity ft/sec (km/hr) | 26.80(29.5) | 26.48(29.13) | | 31-102 |
| Reactor Residence Time sec | 0.397 | 0.385 | 0.013 | 0.021 |
| | | Run No. | 56-1-1 | 74-1-2 |

TABLE 12

FEED CHARACTERISTICS

| | Naphtha Feed | |
|---|---|---|
| | Naphtha (Catalytic Reformer Feed) Subject Invention | Naphtha (Kuwait Full Range) Gulf U.S. Pat. No. 4,097,363 |
| IBP (°F.) | 190 | 122 |
| MABP | 261 | 242.6 |
| FBP | 360 | 359.6 |
| MW | 116 | — |
| H2, wt. % | 14 | 14.89 |
| Sulfur, wppm | 240 | 100 |
| Specific gravity (60° F.) | 0.748 | 0.721 |

TABLE 13

| | Heavy Gas Oil Feed | |
|---|---|---|
| | Subject Invention | Gulf U.S. Pat. No. 4,097,363 |
| IBP (°F.) | 711 | 669.2 |
| MABP | 943 | 820.4 |
| FBP | 1047 | 1005.8 |
| MW | 550 | |
| H2, wt. % | 12 | 12.69 |
| Specific Gravity (60° F.) | 0.923 | 0.887 |

Although the respective feed naphthas and heavy gas oils are similar in physical characteristics, the feed examples employed herein are both somewhat heavier than in the said patent. This fact, coupled with the lower steam dilutions employed herein might lead one to expect significantly lower yields of ethylene and other unsaturates for these feeds versus the feeds in the said patent. As is evident from Table 10, the opposite is in fact true: the yields obtained with the subject invention are generally superior to those of the patent at equivalent methane. Methane is being used in Table 10 as the measure of processing severity.

A major difference is the capability to process the feeds at significantly reduced residence times, as discussed in the foregoing. The order-of-magnitude lower residence times of this process versus the Gulf process are noteworthy.

It can be seen that numerous advantages result from the present process. Most importantly, heat transfer, particle to gas, is so rapid between the low velocity particle and high velocity gas that particle acceleration can be stopped before erosive solids velocities are reached. Heat transfer is optimized versus erosive forces. Reactor residence time is thus reduced. Length of path is reduced so that smaller, more compact apparatus can be employed. Higher temperatures can be used at the short residence times since solids velocity is controlled independently. Short residence time, high efficiency tee separators may be used. The high heat transfer rates (heat-up rate ~$10^6$° F./sec.) and rapid gas/solid separation, allow overall residence times at reaction temperatures to be kept to e.g. 20–50 ms. These times are shorter than any disclosed in the prior art.

Modifications of the process as described may be made, for example: incorporating a catalyst on the solid particles to enhance selectivity and/or yields at less severe conditions. Such modifications may be made without sacrificing the invention's chief advantages.

The primary application of this invention, as described hereinbefore, is in the cracking of heavier cuts of naturally occurring hydrocarbons, e.g. gas oils, residua, to make higher value products, most notably ethylene. The concept is also applicable to other reactions which require high temperature for a short residence time since this invention provides a means to obtain such a condition for any vapor, or mixed vapor/-liquid, in contact with pre-heated particulate solids.

An example of the potential of this invention is in the pyrolysis of dichloroethane to vinyl chloride, as part of a balanced ethylene oxychlorination process to make the vinyl chloride. This invention could be substituted for the commonly used multi-tube furnace (e.g. B. F. Goodrich technology) operating at 470°-540° C. and 25 atm for 9 to 20 seconds. By-products include tars and coke which build up on the tube walls and must be removed by burning them out with air; and also include acetylene, benzene and methyl chloride. These by-products should be significantly reduced by use of this invention.

What is claimed is:

1. A process for thermally cracking hydrocarbons wherein a hydrocarbon feed gas which may contain some liquid is contacted with hot particulate solids in a reactor which comprises introducing the solids at low, no or negative velocity into contact with the feed gas which is at substantially higher velocity, to entrain the solids in the gas,transfer heat from solids to feed and crack the same, separating relatively cool solids from product gas while the solids are substantially below the velocity of the product gas, and the reactor gas residence time is the range of 10 to 40 ms.

2. A process for thermally cracking hydrocarbons wherein a hydrocarbon feed gas which may contain some liquid is contacted with hot particulate solids in a reactor which comprises introducing the solids at a velocity in the range of 0-50 ft./sec. or at a negative velocity into contact with the feed at a substantially higher velocity in the range of 30 to 500 ft./sec., a reactor residence time being selected in the range of 10-40 ms and the reactor having a length of path for solids and gas such that said residence time is achieved and the solids exit velocity is substantially below the gas exit velocity.

3. The process according to claim 2 in which said solid particles comprise particles in the size range of 50-300 microns.

4. The process according to claim 2 in which a hydrocarbon feed is used which is a gas-liquid mixture at reaction conditions.

5. The process according to claim 2 in which a hydrocarbon feed is used which is normally liquid, gelatinous or solid.

6. The process according to claim 2 in which a hydrocarbon feed is used selected from the group consisting of atmospheric gas oil and atmospheric gas oil residua and vacuum gas oil and vacuum gas oil residua.

7. The process according to claim 2 in which a hydrocarbon feed is used which is a crude oil.

8. The process according to claim 2 in which the solids accelerate to not more than 80% of the velocity of the gas with which they are in contact.

9. The process according to claim 8 in which the solids accelerate to not more than 50% of the velocity of the gas.

10. The process according to claim 2 in which the thermal cracking of hydrocarbons is carried out substantially without the addition of steam.

11. The process according to claim 2 in which the hydrocarbon is diluted with steam or other inert diluent gas.

12. The process according to claim 2 in which the hydrocarbon is diluted with steam at a weight ratio of steam to hydrocarbon of about 0.01/1 to 6/1.

13. The process according to claim 12 in which the weight ratio is about 0.1/1 to 1.

14. A process for thermally cracking hydrocarbons wherein a hydrocarbon feed gas which may contain some liquid is contacted with hot particulate solids in a reactor which comprises introducing 50-300 $\mu$ particles at 0-50 ft./sec. into contact with the feed gas at a gas residence time of 10-40 ms and which is at substantially higher velocity in the range of 30-500 ft./sec. to entrain the solids in the gas, transfer heat from solids to feed and crack the same at reaction temperatures in the range of about 1500°-2200° F., causing the solids to accelerate in passing through the reactor, separating cooled solids from product gas while the solids are substantially below the velocity of the product gas and then quenching the product gas.

15. The process according to claim 14 wherein the hot particulate solids fall into the reactor by gravity.

16. The process according to claim 14 wherein the feed gas velocity is in the range of 300-400 ft./sec. and the particle size is in the range of 100-200 $\mu$.

17. The process according to claim 2 in which the feed is introduced into one or more inlets located along one end of a reactor which is rectangular, oval or cylindrical in cross-section, mixes with introduced solids, and gas and solids pass lengthwise of the reactor.

18. The process according to claim 17 in which solids are separated from product gas by means of an inertial separator.

19. The process according to claim 18 in which solids are separated from product gas in an inertial tee separator which forms part of an integral reactor/separator.

20. The process according to claim 19 in which solids and product gas flow into the run of two tees in series; gas flows out the branch of the first tee, changing its direction by about 90° and disengaging from the solids; and solids come to rest against a layer of deposited particles and fall downward into the branch of the second tee.

21. The process according to claim 19 in which the product gas is quenched with an inert, direct quench fluid after separation of solids from the product gas and without substantial quenching of the solids.

22. The process according to claim 21 in which the direct quench fluid is steam.

23. The process according to claim 2, 18 or 19 in which the separated product gas is quenched in an indirectly cooled fluid bed.

24. The process according to claim 2 in which the separated relatively cool solids are reheated and recycled to the reactor.

25. The process according to claim 24 in which the separated relatively cool solids are reheated in a countercurrently staged system in a plurality of heaters.

26. The process of claim 1 or 2 or 14 in which the product gas is quenched after separation from the solids.

* * * * *